US009186527B2

(12) United States Patent
Bergmann et al.

(10) Patent No.: US 9,186,527 B2
(45) Date of Patent: Nov. 17, 2015

(54) RAPPELLING DEVICE

(76) Inventors: Uwe Bergmann, Spenge (DE); Dirk Bergmann, Spenge (DE)

( * ) Notice: Subject to any disclaimer, the term of this patent is extended or adjusted under 35 U.S.C. 154(b) by 172 days.

(21) Appl. No.: 13/638,645

(22) PCT Filed: Mar. 30, 2010

(86) PCT No.: PCT/EP2010/054254
§ 371 (c)(1),
(2), (4) Date: Oct. 1, 2012

(87) PCT Pub. No.: WO2011/120566
PCT Pub. Date: Oct. 6, 2011

(65) Prior Publication Data
US 2013/0056303 A1 Mar. 7, 2013

(51) Int. Cl.

| | |
|---|---|
| ***A47L 3/04*** | (2006.01) |
| ***A62B 1/16*** | (2006.01) |
| ***A62B 35/00*** | (2006.01) |
| ***A63B 29/02*** | (2006.01) |
| ***E06C 7/18*** | (2006.01) |
| ***A62B 1/14*** | (2006.01) |
| ***A62B 1/10*** | (2006.01) |

(52) U.S. Cl.
CPC .... *A62B 1/14* (2013.01); *A62B 1/10* (2013.01)

(58) Field of Classification Search
CPC ..... A62B 1/06; A62B 1/08; A62B 1/10; A62B 1/14; A62B 35/04; A62B 35/0093
USPC ..... 182/3, 4–7, 189–192
See application file for complete search history.

(56) References Cited

U.S. PATENT DOCUMENTS

| | | | | | |
|---|---|---|---|---|---|
| 456,532 | A | * | 7/1891 | Bliss | 182/192 |
| 1,022,417 | A | * | 4/1912 | Heydlauff | 182/192 |
| 1,647,506 | A | * | 11/1927 | Coughtry | 182/238 |
| 2,791,397 | A | * | 5/1957 | Coffman | 182/239 |
| 3,662,992 | A | * | 5/1972 | Vittert | 254/391 |
| 3,739,875 | A | * | 6/1973 | Clark-Padwicki | 182/6 |
| 3,797,608 | A | * | 3/1974 | Virdis | 182/112 |
| 4,097,023 | A | * | 6/1978 | Muller | 254/391 |
| 4,223,761 | A | * | 9/1980 | Sonnberger | 182/5 |
| 4,359,139 | A | * | 11/1982 | Bloder | 182/234 |
| 4,662,475 | A | * | 5/1987 | Rutschi et al. | 182/5 |
| 4,830,340 | A | * | 5/1989 | Knitig | 254/391 |
| 4,846,075 | A | * | 7/1989 | Tupper | 104/209 |
| 4,923,037 | A | * | 5/1990 | Stephenson et al. | 188/188 |

(Continued)

FOREIGN PATENT DOCUMENTS

| | | | |
|---|---|---|---|
| DE | 20015164 | U1 | 12/2000 |
| DE | 102006009332 | A1 | 9/2007 |
| GB | 07468 | A | 0/1912 |

*Primary Examiner* — David R Dunn
*Assistant Examiner* — Shiref Mekhaeil
(74) *Attorney, Agent, or Firm* — Richard M. Goldberg

(57) ABSTRACT

Rappelling device having a casing (12) that is movable along a rope (18) and in which a pulley (16) and a guide roller (14) are supported rotatably, such that the rope, during rappelling, is held in frictional contact with the periphery of the pulley (16), the device having a braking device (36) for the pulley (16) and a coupling device (28) for suspending a load (74) to be rappelled, the casing (12) forms a rope channel (26) that extends between the guide roller (14) and the pulley (16) and into which the rope (18) can be placed in extended state, and in that the coupling device (28) is arranged at the casing (12) in a position that is offset from the rope passage (26) towards the side of the pulley (16).

9 Claims, 3 Drawing Sheets

(56) References Cited

U.S. PATENT DOCUMENTS

| | | | | |
|---|---|---|---|---|
| 5,722,612 | A * | 3/1998 | Feathers | 242/381.5 |
| 6,029,777 | A * | 2/2000 | Rogelja | 182/193 |
| 6,155,384 | A * | 12/2000 | Paglioli | 188/65.2 |
| 6,810,997 | B2 * | 11/2004 | Schreiber et al. | 182/238 |
| 6,945,357 | B1 * | 9/2005 | Flux | 182/36 |
| 7,097,005 | B2 * | 8/2006 | Angermann | 188/181 A |
| 7,108,099 | B2 * | 9/2006 | Ador | 182/5 |
| 7,237,651 | B2 * | 7/2007 | Avots et al. | 182/234 |
| 8,387,751 | B2 * | 3/2013 | Miceli | 182/5 |
| 2006/0289235 | A1 * | 12/2006 | Chen | 182/192 |
| 2009/0020373 | A1 * | 1/2009 | Kowatsch | 188/65.2 |
| 2009/0057631 | A1 * | 3/2009 | Rinklake | 254/277 |
| 2012/0247879 | A1 * | 10/2012 | Kowatsch et al. | 188/65.3 |
| 2013/0105247 | A1 * | 5/2013 | Casebolt | 182/241 |

* cited by examiner

RAPPELLING DEVICE

BACKGROUND OF THE INVENTION

The invention relates to a rappelling device having a casing which can be moved along a rope and in which a pulley and a guide roller are rotatably supported in such a manner that the rope during rappelling is held in frictional contact with the periphery of the pulley, the device having a braking device for the pulley and a coupling device for suspending a load to be rappelled.

Such rappelling devices are needed for example for the service personnel of wind power plants. Modern wind power plants with an output of several megawatt presently can reach boss heights of up to 160 m and are installed both onshore and offshore for generating electricity. On the top of the tower, these plants have an engine house with relatively large dimensions that may accommodate up to 30 persons for servicing works. The high personal placement for service and repair shall minimize the down time of the plant.

Access to the engine house of the wind power plant is generally achieved by means of a ladder equipped with a protection system or by means of a lift cage inside the tower. In an emergency case, for example when the engine house or the base of the power is on fire, it must be ensured that all persons present in the plant can be evacuated immediately via an alternative escape path.

Rappelling apparatus are known which permit a person to rope down from a platform in the engine house outside of the tower. These apparatus have a rappelling rope, e.g. a polyamide core-and-sheath rope, with a snap-hook attached to both ends thereof, and a braking unit which limits the rappelling speed to 2 m/s at maximum. The person to be roped down buckles on a safety belt or a safety loop which is to be fastened at the snap-hook at the top end of the rappelling rope. During rappelling the rope runs over a pulley with a speed that is determined by the braking unit.

Rappelling apparatus that can be used by two persons at a time and operate in a shuttle mode have also been known.

However, these apparatus are not sufficient for a timely evacuation of a larger number of persons. Even the simultaneous use of several rappelling apparatus becomes problematic with increasing height of the power, because the wind-induced movements of the persons being rappelled and the ropes are difficult to control, so that the ropes may easily get entangled, with the result that the rescue operation may be delayed or made impossible.

DE 10 2006 009 332 A1 discloses a rappelling device of the type indicated above, wherein the rope passes in meander configuration over several guide rollers at a rope pulley, so that each of these rollers is clasped on an angle of more than 180° and consequently a larger friction is achieved between the rope and the guide rollers and the pulley.

SUMMARY OF THE INVENTION

It is an object of the invention to provide a rappelling device which permits to rappel a plurality of loads, in particular persons, simultaneously on the same rope.

In order to achieve this object, the casing forms a rope channel extending between the guide roller and the pulley, into which channel the rope can be inserted in a stretched-out state, and the coupling device is arranged in a position on the casing which is offset with respect to the rope channel towards the side of the pulley.

Even when the rope is under tensile stress, because one or more persons are roping down already, this rappelling device may be attached to the rope such that the rope passes through the rope channel. When, then, the weight of the load acts upon the coupling device, this causes the casing to be tilted such that the guide roller and the pulley press onto the rope from opposite sides, with the consequence that the rope clasps the pulley on a certain peripheral segment, resulting in the necessary frictional contact between the rope at the pulley.

Useful details of the invention are indicated in the dependent claims.

Preferably, the pulley has, at its periphery, a V-shaped groove in which the rope is held clampingly when the rope is biased against the pulley. This permits to achieve a high frictional contact between the rope and the pulley even when, for reasons of fire safety, a steel rope is used as rappelling rope.

Preferably the casing has a flap lid which may be opened for placing the rope in the rope channel and which can then be latched in a position in which it closes the rope channel.

BRIEF DESCRIPTION OF THE DRAWINGS

An embodiment example of the invention will now be explained in greater detail in conjunction with drawing, wherein.

DETAILED DESCRIPTION

Figure 1:
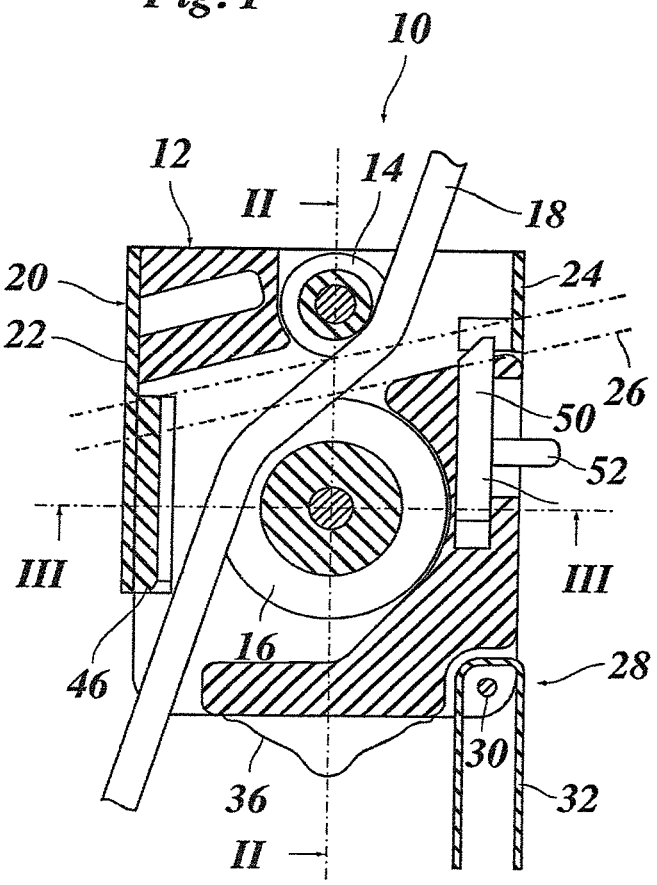
FIG. 1 shows a sectional view of the rappelling device according to the invention.

The rappelling device 10 that has been shown in FIG. 1 comprises a casing 12 that is preferably made of metal and in which a guide roller 14 and a pulley 16 for a rope 18 are supported rotatably. The front side of the casing 12 that is not visible in FIG. 1 is partly closed by a flap lid 20 of which only wall portions 22, 24 straddling the left and right smaller sides of the casing are visible in FIG. 1. When the flap lid 20 is opened, there is free access to a rope channel 26 that is indicated in phantom lines in FIG. 1 and extends straight between the guide roller 14 and the pulley 16. On the side of the rope channel 26 that faces the pulley 16, a coupling device 28 is arranged in a corner of the casing 12, and a load to be rappelled can be suspended at this coupling device. In the example shown, the coupling device is formed by a grommet 30 and a belt loop 32 only part of which has been shown and to which the load may be attached with a snap-hook or the like.

Figure 2:
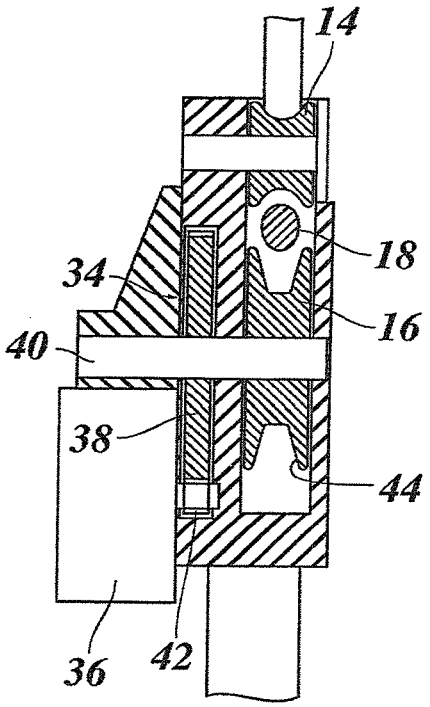
FIG. 2 shows a section along the line II-II in FIG. 1.
Figure 3:
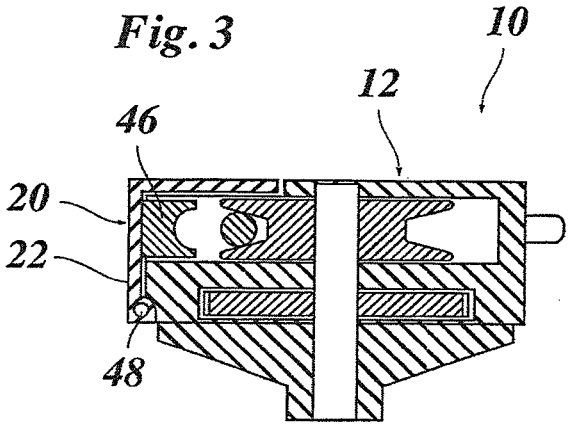
FIG. 3 shows a section along the line III-III in FIG. 1.

As can be seen more clearly in FIGS. 2 and 3, a transmission 34 connects the pulley 16 to a braking device 36 that is mounted to the casing 12 and may for example be formed by a known centrifugal brake. The pulley 16 and a larger gear 38 of the transmission 34 are mounted non-rotatably on a common shaft 40. The gear 38 meshes with a smaller gear 42 that is supported on an input shaft of the braking device 36. In this way, the rotary movement of the pulley 16 is transmitted with speed enhancement onto the centrifugal brake.

As is further shown in FIG. 2, the pulley 16 is formed in its peripheral surface with a V-shaped groove 44 which, on its bottom, is narrower than the diameter of the rope 18, so that the rope is clampingly held in the groove 44 when it is biased against the pulley 16.

A rope guide 46 forming a guide chute for the rope 18 is mounted to the internal side of the wall portion 22 of the flap lid 20, as can be seen in the cross-section in FIG. 3. Moreover, FIG. 3 shows a hinge 48 that connects the flap lid 20 pivotally to the casing 12 and, in the view shown in FIG. 3, is arranged below the rope guide 46. The opposite wall portion 24 of the flap lid 20 (FIG. 1) is lockable at the casing with a latch 50. The latch 50 is elastically biased into the locked position and snaps-in automatically when the flap lid is closed. An unlocking pin 52 projects from the casing and permits to unlock and open the flap lid. The flap lid 20 itself may be elastically biased into the open position, so that it will flap open automatically when unlocked.

Figure 4:
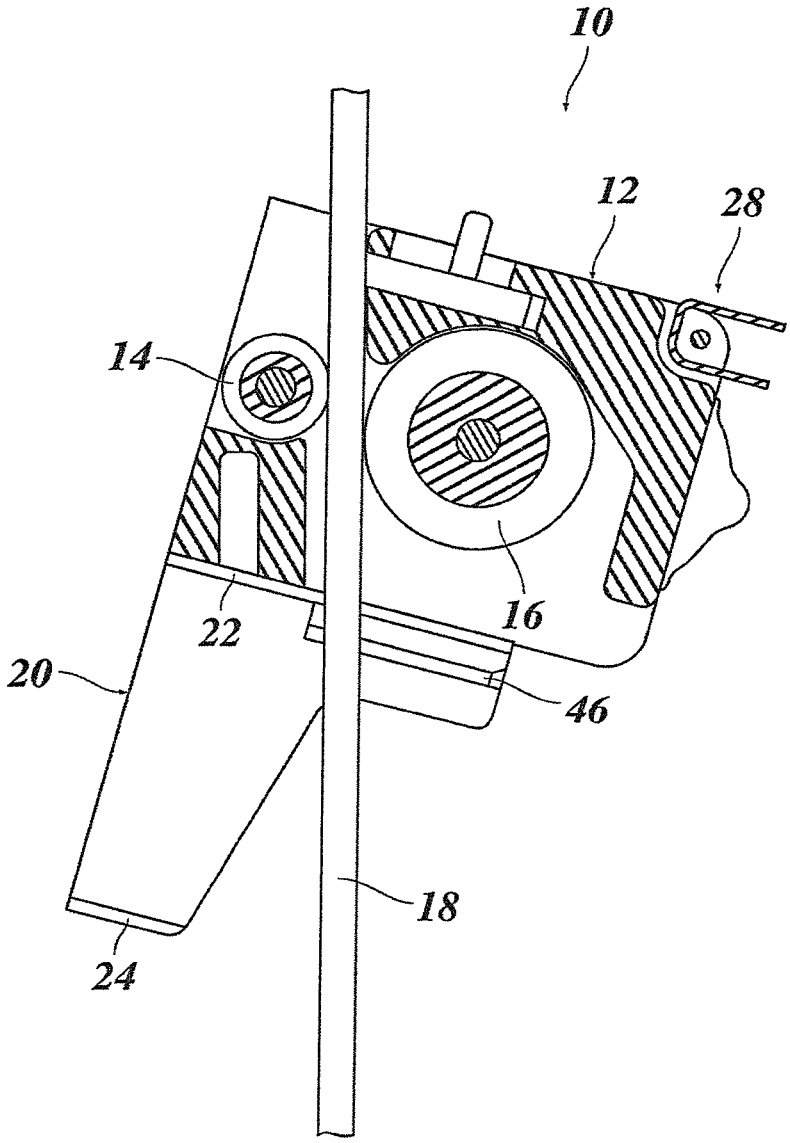
FIG. 4 shows a sectional view of the rappelling device in opened condition, when it is attached to a rope.

FIG. 4 shows the rappelling device 10 in the condition in which the flap lid 20 is opened. The rope 18 to which a load may have been attached already with another rappelling device further below and which is therefore under tensile strain extends straight and vertically. The rappelling device 10 may now be placed against the rope 18 from one side in the posture shown in FIG. 4, so that the rope 18 is accommodated in the rope channel between the guide roller 14 and the pulley 16. The casing 12 is then manually pivoted clock-wise in FIG. 4, so that the guide roller 14 and the pulley 16 approach the rope 18 from opposite sides until, finally, the rope is received in a peripheral groove of the guide roller 14 and in the V-shaped groove 44 of the pulley. The center of gravity of the casing 12 coincides approximately with the axis of rotation of the pulley 16, i.e. is located on the right side of the rope passage in FIG. 4. Consequently, the pivotal movement of the casing 12 is assisted by the own weight of this casing. In this way, the casing reaches a position in which the flap lid 20 can be closed. In this process, the rope guide 46 that is offset from the hinge 48 (FIG. 3) move towards the rope 18 and presses onto the rope 18 with its lower end, so that the rope is slightly deflected. In this way, the casing 12 is held in frictional contact with the rope by the rope guide 46, so that the rappelling device 10 will not slide down along the rope even when the casing 12 is let loose.

When, now, the load to be roped down is suspended at the coupling device 28, the casing 12 is subject to a large torque that has the tendency to further pivot the casing clock-wise in FIG. 4. In this process, the rope guide 46 tends to move away from the rope 18 whereas the rope is slightly deflected at the guide roller 14 and the pulley 16, as has been shown in FIG. 1. The pivotal center about which the casing 12 is pivoted is located in the rope channel 26 on the straight line that connects the axis of the guide roller 14 and the pulley 16. Consequently, the load applied to the coupling device acts upon the casing 12 via a long lever arm, so that it exerts a high torque having the tendency to further deflect the rope 18. This has the consequence that the rope will clasp the pulley on a larger peripheral segment and will also be pressed deeper into the V-shaped groove 44. This creates a reliable frictional contact between the rope 18 and the pulley 16. Consequently, when the rappelling device 10 moves down along the rope 18 under the weight of the load, the pulley 16 is rotated, and the rotary movement is transmitted to the braking device 36 via the transmission 34. When the rappelling speed reaches the certain value, e.g. 2 m/s, the centrifugal brake in the braking device 36 becomes active, so that the pulley 16 is braked with a force that is multiplied by the transmission 34 whereas the frictional contact with the rope 18 is maintained. In this way, it is assured that the load will be rappelled with constant speed.

Figure 5:
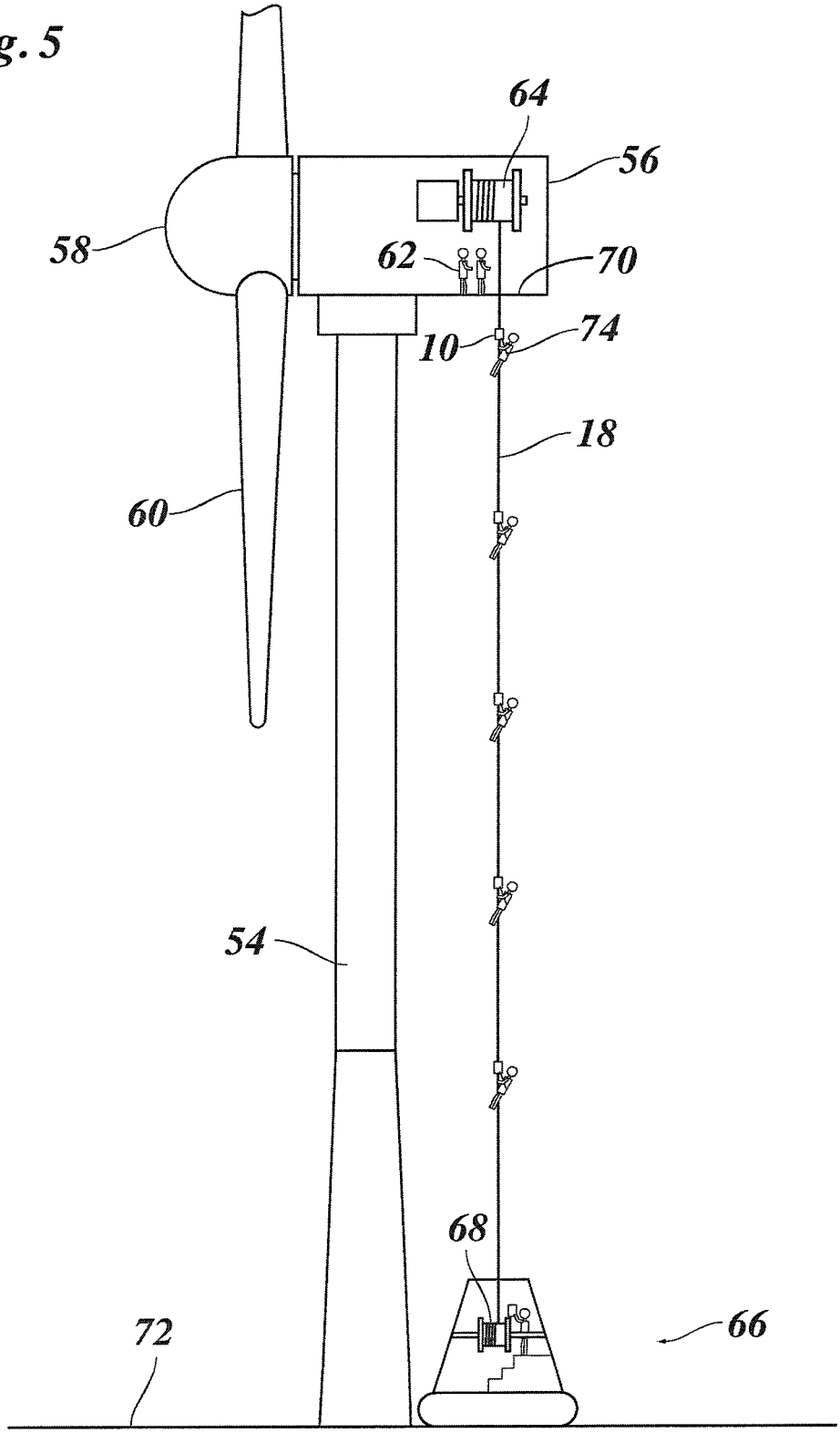
FIG. 5 is a schematic sketch of a rescue system for rescuing persons from a wind power plant by means of rappelling devices according to the invention.

For illustrating a possible use of the invention, FIG. 5 schematically shows an offshore wind power plant having a tower 54, a gondola 56, a hub 58 and rotor blades 60. The gondola 56 accommodates an engine house where a larger number of persons 62 may be present during servicing or repair works.

The wind power plant is equipped with a rescue system which permits, in an emergency case, e.g. when the machine house catches fire, to evacuate the service personnel in shortest possible time via a separate rescue path (which does not pass through the tower 54). The rescue system comprises, installed in the gondola 56, an unwinding device 64 for the rope 18. For unwinding the rope in a controlled manner, the unwinding device 64 should include a brake, e.g. a centrifugal brake. Moreover, a motor should be present for recoiling the rope 18. For reasons of fire safety, the rope 18 should preferably be a steel rope. A weight 66 accommodating a tensioning device 68 for the rope 18 is suspended at the lower end of the rope 18. In the example shown, the weight 66 is formed by a life raft.

Under normal conditions of the wind power plant the rope 18 is completely coiled on the unwinding device 64, the life raft is collapsed and stowed in the gondola. When an evacuation becomes necessary, the persons 62 proceed to a platform 70 that is formed in the gondola 56, where the unwinding device 64 is installed above an escape hatch that has not been shown in detail. The life raft suspended at the rope 18 is roped down through the escape hatch, and the rope is unwound with the unwinding device 64 until the life raft reaches the water surface 72. In a manner known per-se, a trigger mechanism which has not been shown triggers the inflation of the life raft with compressed air, so that the life raft will float on the water surface. Since, then, the rope 18 is no longer tensioned by the weight of the life raft, it is now the tensioning device 68 that assures that the rope is always held under certain, essentially constant tensile stress. This prevents the rope 18 from swinging and at the same time limits the possible drift-off movement of the safety raft.

Once the rope has been stabilized in this way, the evacuation of the persons 62 may start. To that end, each person 62 buckles-on a safety belt or a safety loop 74 that is attached to the coupling device 28 of a rappelling device 10 of the type described above. The person attaches the rappelling device 10 to the rope 18 in the manner shown in FIG. 5 and ropes down along the rope. In this way, the persons 62 may be rappelled one after the other along the rope 18. When the number of persons that are suspended on the rope 18 during the rappelling operation increases, the rope experiences an increasing longitudinal expansion. This, however, is compensated by the tensioning device 68 which holds the rope under constant tensile stress. As soon as the persons have roped down to the lower end of the rope and have reached the life raft, they detach the rappelling device 10 from the rope (by opening the flap lid 20) and proceed to the interior of the life raft, so that the "landing place" is immediately cleared for the next person roping down. In this way, even a larger number of persons can be evacuated in very short time.

Optionally, the rappelling device 10 may be configured such that two persons may be rappelled simultaneously while being suspended on the coupling device 28 of the same rappelling device.

For the purpose of reliably preventing the rappelling device 10 from moving down along the rope 18 alone, before a load has been suspended thereto, the rappelling device may be safeguarded in a rest position by a detachable locking pin which locks the pulley 16 or the braking device 36 or a member of the transmission 34. In order to make the rappelling device operative, the locking pin is withdrawn after the person to be rappelled has attached itself to the coupling device 28 and before he or she plunges through the escape hatch.

The invention claimed is:

1. Rappelling device comprising:

a casing that is movable along a rope, said casing having a plate, a guide roller having a central guide roller axis extending axially through the guide roller and the guide roller axis mounted at a first fixed position to the plate of the casing, the guide roller supported rotatably at the first fixed position in the casing about the guide roller axis, a pulley supported rotatably at a second fixed position to the plate of the casing and about a central pulley axis, such that the rope, during rappelling, is held in frictional contact with a periphery of the pulley, the central guide roller axis and the central pulley axis being immovable relative to each other at all times, a centrifugal braking device for braking the pulley to maintain a predetermined constant speed of rappelling, and a coupling device for suspending a load to be rappelled, wherein the casing forms a rope channel that extends between the guide roller and the pulley and into which the rope is adapted to be placed in an extended state in a straight line, and wherein the coupling device is arranged at the casing in a position that is offset from the rope channel towards a side of the pulley.

2. Rappelling device according to claim 1, wherein the periphery of the pulley has a V-shaped groove and a width of a bottom of the V-shaped groove is smaller than a diameter of the rope.

3. Rappelling device according to claim 1, wherein the casing has a lid adapted to be locked in a closed position for closing the rope channel.

4. Rappelling device according to claim 3, wherein the lid is a flap lid.

5. Rappelling device according to claim 4, further comprising a rope guide formed on an inner side of the flap lid, and when the flap lid is closed, the rope guide presses upon the rope at least in a state in which the casing assumes a predetermined angular posture.

6. Rappelling device according to claim 5, wherein the rope guide is arranged such that it presses a portion of the rope onto the pulley.

7. Rappelling device according to claim 1, further comprising a transmission which connects the pulley with the braking device.

8. Rappelling device according to claim 1, wherein the casing, when viewed from a direction parallel to axes of the pulley and the guide roller, has an approximately rectangular shape with a major axis, the axes of the pulley and the guide roller are arranged on the major axis, and the coupling device is arranged in a corner of the rectangular shape located on said side of the pulley that is opposite to the guide roller.

9. Rappelling device according to claim 1, wherein the casing is rotatable about a casing axis, and wherein suspension of the load to the coupling device causes the casing to rotate about the casing axis to cause the rope to engage a larger arcuate portion of the pulley.

* * * * *